US006142599A

United States Patent [19]

Ishinaga et al.

[11] Patent Number: 6,142,599

[45] Date of Patent: Nov. 7, 2000

[54] METHOD FOR INK-JET RECORDING AND AN INK-JET RECORDING APPARATUS

[75] Inventors: Hiroyuki Ishinaga, Tokyo; Masami Ikeda, Yokohama; Tsutomu Abe, Isehara; Toshio Kashino, Chigasaki, all of Japan

[73] Assignee: Canon Kabushiki Kaisha, Tokyo, Japan

[21] Appl. No.: 08/671,370

[22] Filed: Jun. 27, 1996

[30] Foreign Application Priority Data

Jun. 29, 1995 [JP] Japan ..... 7-164322

[51] Int. Cl.[7] ..... B41J 2/205

[52] U.S. Cl. ..... 347/15

[58] Field of Search ..... 347/15, 43, 19, 347/14; 358/298

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,499,479 | 2/1985 | Chee-Shuen Lee et al. . | |
| 4,558,333 | 12/1985 | Sugitani et al. . | |
| 4,560,997 | 12/1985 | Sato et al. . | |
| 4,723,129 | 2/1988 | Endo et al. . | |
| 4,740,796 | 4/1988 | Endo et al. . | |
| 4,746,935 | 5/1988 | Allen . | |
| 4,860,026 | 8/1989 | Matsumoto et al. | 347/15 |
| 5,142,374 | 8/1992 | Tajika et al. | 358/298 |

FOREIGN PATENT DOCUMENTS

| | | | |
|---|---|---|---|
| 57-160654 | 10/1982 | Japan . | |
| 59-207265 | 11/1984 | Japan . | |
| 62-261453 | 11/1987 | Japan | 347/48 |
| 63-053052 | 3/1988 | Japan . | |
| 63-502261 | 9/1988 | Japan . | |
| 1-285359 | 11/1989 | Japan . | |
| 3-166959 | 7/1991 | Japan . | |
| 5-038818 | 2/1993 | Japan . | |

*Primary Examiner*—John Barlow
*Assistant Examiner*—Craig A. Hallacher
*Attorney, Agent, or Firm*—Fitzpatrick, Cella, Harper & Scinto

[57] ABSTRACT

A method for making a record with multiple levels of a gradation on a recording medium, has the following steps:

preparing a device for ejecting inks of different densities in a plurality of ejection amounts, respectively;

linearizing a relationship between gradation and image density so that levels of the gradation of each of the inks of different densities can be interpolated with others; and making a record on a recording medium in response to multiple-level recording data in accordance with the relationship between gray scale and image density.

5 Claims, 14 Drawing Sheets

METHOD FOR INK-JET RECORDING AND AN INK-JET RECORDING APPARATUS

BACKGROUND OF THE INVENTION

1. Field of the Invention

The present invention relates generally to recording apparatuses for recording information such as characters and images, and also the present invention relates to information-processing systems using such apparatuses as output devices, such as facsimiles, printers, word-processors, and personal computers. The term "recording" refers to all kinds of procedures for providing ink on ink supports such as cloth, yarn, paper, and other sheet materials (i.e., printing process, image-forming process, copying process, dye or staining process, and the like). Therefore the field of the invention is not limited to the field of information-processing, and so it is also applicable to other fields including apparel industries using the ink supports for receiving ink such as cloth, yarn, paper, and other sheet materials.

2. Description of the Related Art

Heretofore, ink-jet recording apparatuses have been used as output means on the commercial basis, for example they have been used as printers as output terminals of copying machines, facsimiles, electronic typewriters, word processors, work stations, and the like, and also such as handy- or portable-type printers equipped in personal computers, host computers, optical disk apparatuses, video apparatuses, and so on. In these cases, each of the ink-jet recording apparatuses is configured to meet a specific function, a usage pattern, and the like of the corresponding apparatus.

In general, the ink-jet recording apparatus comprises a carriage on which a recording means (a recording head) and an ink tank are mounted, a paper-feed means for feeding a sheet of recording paper, and a control means for controlling movements of these means. The recording head for ejecting ink droplets from a plurality of orifices thereof is driven to sequentially scan over a surface of the recording medium (i.e., serial-scanning movement) in the direction (i.e., main-scanning directions perpendicular to the feeding direction (i.e., sub-scanning direction) of the recording paper at the period of a recording movement. In addition, the recording medium is intermittently shifted at a distance corresponding to a recording width of the recording medium at the period of a non-recording movement. In this way, therefore, the recording apparatus performs a recording movement by ejecting ink droplets from the recording head on the recording paper in accordance with recording signals and it shows an excellent cost/performance ratio, so that it has been widely used as one that performs the recording movement silently.

Furthermore, it is possible to perform a high-speed recording movement by using a recording head on which a plurality of nozzles for ejecting ink are arranged in a line along the sub-scanning direction because the recording head records an image with a width corresponding to the number of nozzles by carrying out the scanning movement one time.

In the case of an ink-jet recording apparatus for multiple-color recording, ink droplets can be ejected from plural recording heads that correspond to different colors, respectively, and so a color image can be formed by placing ink droplets one upon another. For the multiple-color recording, in general, four different types of the recording heads and the ink cartridges corresponding to three primary colors (i.e., yellow (Y), magenta (M), and cyan (C)) and/or black (B) are required. In recent years, by the way, recording apparatuses having three or four recording heads for full-color recording have been developed and used in practical applications.

For the conventional recording apparatuses described above, there are several kinds of means for generating energies to be used for ejecting ink, such as electromagnetic transducers (e.g., piezo elements) and electrothermal transducers having electric heating elements to heat a liquid. Among those means, the recording head that uses the means in the type (so-called bubble-jet type) of ejecting a liquid by utilizing heat energies (i.e., utilizing a membrane-boiling phenomenon) is possible to perform a high-resolution recording because the ejection orifices can be arranged at a high density.

The bubble-jet process for forming an ink droplet by the recording head constructed as described above will be described briefly in the followings.

First of all, a membranous air bubble is generated by the phenomenon of film boiling to such an extent as to cover a surface of a thermal resistor (hereinafter, referred as a heater) when the heater reaches to a predetermined temperature. An inner pressure of the bubble is extremely high, so that the bubble pushes ink in a nozzle out. Then the ink moves toward an outside of the nozzle and also toward a common liquid chamber in the opposite direction thereof by effective force as a result of the pushing out. While this action is in process, the inner pressure of the bubble becomes negative and the ink loses velocity in the nozzle as a result of causing a flow resistance in a path of flow in addition to the effective force. The ink ejected from the orifice to the outside flies faster than the speed of ink in the nozzle, so that the ink becomes constricted and a part thereof is separated to generate an ink droplet by an effect of a balance among the effective force, flow-path resistance, bubble shrinkage, and surface tension of the ink. Then the nozzle is supplied with additional ink from the common liquid chamber by an effect of capillary pressure generated concurrently with the bubble shrinkage, and then the nozzle waits the next pulse to be applied.

Accordingly, the ink-jet recording apparatus in particular attains a rapid-response ink-ejection by using the recording head that uses electrothermal converting elements as energy generating means because of generating the bubble in ink in a liquid path by a drive signal in the form of an electric pulse in a one-to-one relationship and of growing and contracting the bubble quickly and appropriately.

According to the above construction, the ink-jet recording head has advantages in its suitability for being made as compact as possible with a high board density and low manufacturing cost because it is possible to make more use of the advantages of IC technologies and micro-processing technologies with recent considerable improvements in reliability and with recent considerable progress in semiconductor technologies.

For providing a gradation by using the ink-jet recording head constructed as described above, the following methods have been known:

- a method of representing the entire gradation of a picture by elements consisting one of two levels separated by a predetermined threshold, in which an image signal for one element corresponds to one of the two levels (i.e., a dither method);
- a method disclosed in, for example Japanese Patent Laying-open Nos. 207265/1984, 160654/1982, or 53052/1988, representing the entire gradation of a picture, having the steps of changing the size of each liquid droplet by combining plural liquid droplets together and placing the combined liquid droplet on a recording medium (i.e., a liquid droplet modulating method); and a method as disclosed in Japanese Patent Laying-open No. 53052/1988 including the steps of obtaining a gradation of a picture by changing the number of liquid droplets to be placed on a recording medium, where one dot is formed by placing plural liquid droplets on the same place of a recording medium (i.e., a multiple droplets method).

In these methods, however, the dither method has a problem that a resulting image is of low resolution while the liquid droplet modulating method has a problem that it is difficult to obtain a wide range of the gradation so as to correspond to a practical range of a distance between the sheets of paper in the recording device. In the case of the multiple droplets method, on the other hand, it is far superior to the others because it makes possible to record an image at high resolution and multiple levels of gray by selecting an ink-jet recording head that ejects small sized liquid droplets.

Generally, the flow of ink through a recording medium requires several hundred meters per minute after placing an liquid droplet on the recording medium. As a result, a hemispherical droplet is formed on the recording medium when the liquid droplet is placed in a position in advance of ejecting other liquid droplets. A comparatively large sized hemispherical liquid droplet can be formed by placing a following liquid droplet on a preceding liquid droplet on the recording medium. In this case, a size of each pixel can be modified by changing the number of liquid droplets to be placed on the same place one after another.

For obtaining a broader range of the gray-sale than ever before, there is an idea of increasing the number of liquid droplets to be placed one after another and in this case a recording speed may be decreased. However, this kind of problem can be solved by the above method of modulating liquid droplets, a method including the steps of placing the liquid droplets of different volumes one after another on a recording medium by ejecting these droplets in a very short time from different nozzles of the ink-jet recording head disclosed in Japanese Patent Application Publication No. 502261/1988, and so on, and also a combination of these methods.

FIGS. 1A to 1E and FIG. 2 are diagrammatic sectional illustrations and a diagrammatic wave form, respectively, for explaining an example of pixel formation according to a so-called multiple droplets system by which one pixel can be formed by ejecting plural liquid droplets from one nozzle. In this system, a plurality of liquid droplets are substantially placed one after another on the same place of a recording medium (in this case, a sheet of recording paper). Therefore, it is also conceivable that one liquid droplet makes one pixel. In the figures, a pixel frequency f0 is responsible for determining a minimum distance between adjacent pixels in the main-scanning direction of an ink-jet recording head. Also, a frequency f of ejecting liquid droplets is responsible for determining the number of ink droplets to be placed substantially on the same place of the recording paper. In the following description, we will focus on one in a plurality of nozzles formed on the ink-jet recording head mounted on an ink-jet recording apparatus.

At first, an ejection signal P21 is impressed on a ejecting means arranged in a nozzle. Then the ejection means is driven to eject a liquid droplet D1 from the nozzle. The liquid droplet D1 forms a pixel 101 on a sheet of recording paper 103. After a lapse of 1/f hour from the time of impressing the ejection signal P21, an ejection signal P22 is selectively impressed on the ejecting means. Depending on the ejection signal P22, a liquid droplet D2 is ejected on the recording paper 103 so as to be placed over at least a part of the pixel 101 (for the reason that the ink-jet recording head moves for the distance corresponding to 1/f hour in the main-scanning direction). In the same way, plural liquid droplets complete the formation of a pixel 102. That is, the pixel 102 is formed on the pixel 101 by ejecting liquid droplets D3, D4 on the recording paper 103 as a result of impressing ejection signals P23, P24 on the ejecting means at predetermined intervals. In the above steps, a size of the pixel formed on the recording paper 103 can be changed in accordance with the presence or absence of impressing the ejection signals P21, P22, P23, and P24. In the case of forming another pixel so as to be adjacent to the pixel 102, a liquid droplet may be ejected by impressing an ejection signal P21 or the like after the expiration of a predetermined time interval (1/f0).

In the conventional ink-jet recording apparatuses as described above, each recording apparatus adopts a recording system in which one apparatus mounts only one recording head, so that a gradation is represented by varying the number of liquid droplets to be placed on the same place of a recording medium one after another by the recording head to form one dot. If more levels of the gradation are required, the number of liquid droplets to be ejected for one dot is increased and it results in a substantial drop in a recording speed.

If the design of periphery of nozzles is simple, the following technical challenges should be attained. That is, in the case of a recording apparatus for multiple-color recording plural recording heads cannot be driven to provide different width and levels of gradation in each of them, resulting that they are driven to provide the same width and levels of gradation on every occasion. Consequently, an unstable ejection behavior and an undesired gradation may be obtained because of the different ejection properties of inks depending on their types. The number of types of inks should be determined so as to correspond to the desired width or levels of gradation when it is represented by the difference in gradations in color or shades of gray depending on the types of ink.

SUMMARY OF THE INVENTION

Therefore the present invention is conceived so as to solve the above problems.

An object of the present invention is to provide an ink-jet recording apparatus having different types of nozzle groups, which are able to broaden a range of gradation to be expressed (i.e., further dividing the gradation into multiple levels) with relative ease, compared with that of the conventional one.

A second object of the present invention is to provide an ink-jet recording apparatus on which an ink-jet recording head is installed so as to be driven to realize a wide range of gradation, where the head has different types of nozzle groups allowing to broaden the range of gradation with relative ease, compared with that of the conventional one.

A third object of the present invention is to provide an ink-jet recording head having different types of nozzle groups to be supplied with different types of inks, which are able to broaden a range of gradation with relative ease, compared with that of the conventional one.

A fourth object of the present invention is to provide an ink-jet recording apparatus on which an ink-jet recording head is installed so as to be driven to realize a wide range of gradation with relative ease compared with that of the conventional one, where the head has different types of nozzle groups to be supplied with different types of inks, allowing to broaden the range of gradation with relative ease, compared with that of the conventional one.

A fifth object of the present invention is to provide an ink-jet recording method which is able to realize a wide range of gradation with relative ease compared with that of the conventional one.

A sixth object of the present invention is to provide an ink-jet recording method allowing to obtain the properties of forming a gradation enough to perform a linear expression of an image density without causing a stepwise gradation.

In a first aspect of the present invention, there is provided a method for making a record with multiple levels of a gradation on a recording medium, comprising the steps of:

preparing a means for ejecting inks of different densities in a plurality of ejection amounts, respectively;

linearizing a relationship between gradation and image density so that levels of the gradation of each of the inks of different densities can be interpolated with others; and making a record on a recording medium in response to multiple-level recording data in accordance with the relationship between gray scale and image density.

In a second aspect of the present invention, there is provided a gradation recording method for forming pixels of different image densities by ejecting liquid droplets on a recording medium, comprising the step of making a record on the recording medium by using:

a plurality of image densities obtained by a plurality of types of inks having different ink densities; and at least one image density between two of the plurality of image densities, obtained by changing an ejection amount of the ink.

Here, the means for ejecting inks of different densities in a plurality of ejection amounts may be a plurality of energy-generating means arranged in one nozzle.

The line of nozzles that constitutes one recording head may have the inks of different densities.

The plurality of recording heads may include at least one recording head having at least the inks of different densities.

In a third aspect of the present invention, there is provided an ink-jet recording apparatus for making a record with multiple levels of a gradation on a recording medium, comprising means for ejecting inks of different densities in a plurality of ejection amounts, respectively;

means for linearizing a relationship between gradation and image density so that levels of the gradation of each of the inks of different densities can be interpolated with others; and means for making a record on a recording medium in response to multiple-level recording data in accordance with the relationship between gray scale and image density.

In a fourth aspect of the present invention, there is provided an ink-jet recording apparatus for forming pixels of different image densities by ejecting liquid droplets on a recording medium, comprising:

means for obtaining a plurality of image densities by a plurality of types of inks having different ink densities; and means for obtaining at least one image density between two of the plurality of image densities by changing an ejection amount of the ink.

Here, the image densities may be non-linearly changed by changing the ejection amounts of inks.

The image densities may be non-linearly changed by changing the ejection amounts of inks.

The above and other objects, effects, features, and advantages of the present invention will become more apparent from the following description of embodiments thereof taken in conjunction with the accompanying drawings.

DETAILED DESCRIPTION OF PREFERRED EMBODIMENTS

An ink-jet recording apparatus in accordance with the present invention is configured to broaden a range of gradation by means of a plurality of nozzle groups consisting of at least a first nozzle type and a second nozzle type which are different from each other with respect to at least one selected from the amount of an ejected ink, the number of ejected ink droplet, and the number of driving pulses for ejecting ink, per one pixel.

The gradation can be further broadened by the changes in ink properties such as concentration, color tone, viscosity, and mixtures thereof.

By using means of changing the amount of ejecting ink by forming a plurality of heaters per one nozzle in addition to utilizing the different types of ink, the possibility of reproducing the gradation of image increases with an improvement of linear properties of the gradation control in addition to further divided levels of gradation.

By equalizing the driving voltage levels among a plurality of the nozzles, each nozzle can be driven under the same condition as that of the others and in addition another recording means can be easily installed and driven.

By using an electrothermal energy conversion element as an energy generating element, an image-recording with a higher quality can be obtained to overlap with the expanded range of gradation.

Embodiment 1

Hereinafter, a first embodiment of the present invention will be explained in detail with reference to FIGS. 3 and 4.

Figure 1A:
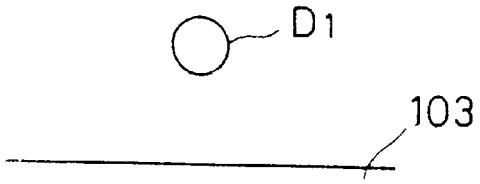
FIGS. 1A to 1E are schematic illustrations for explaining the process of forming a pixel in accordance with a multiple droplets system.
Figure 1B:
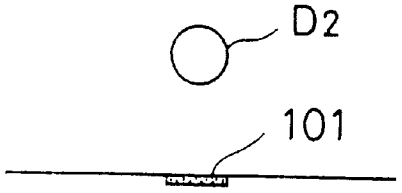
Figure 1C:
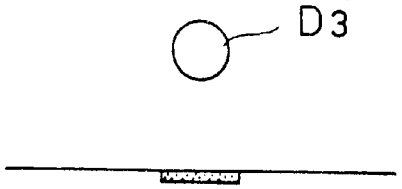
Figure 1D:
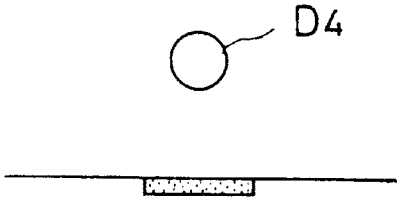
Figure 1E:
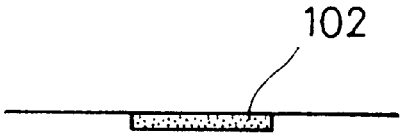
Figure 2:
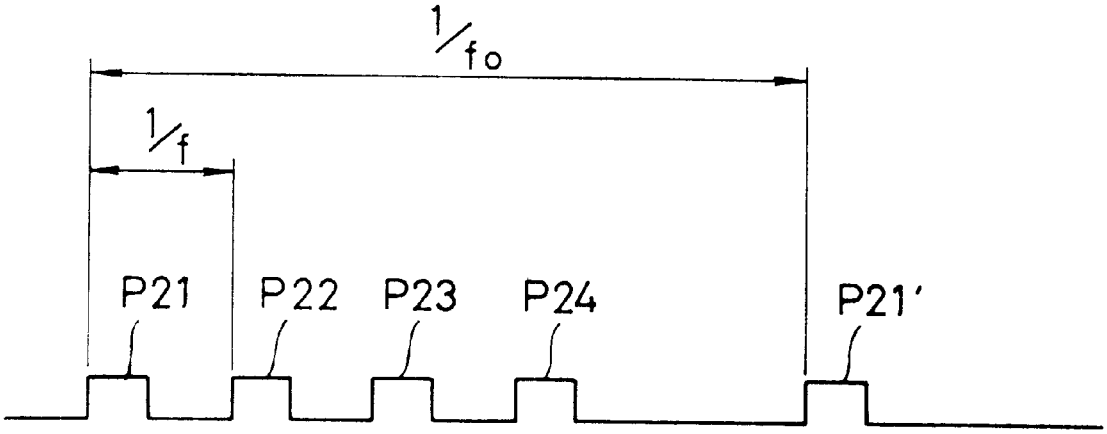
FIG. 2 is a schematic illustration for explaining the process for forming a pixel in accordance with a multiple droplets system.
Figure 3:
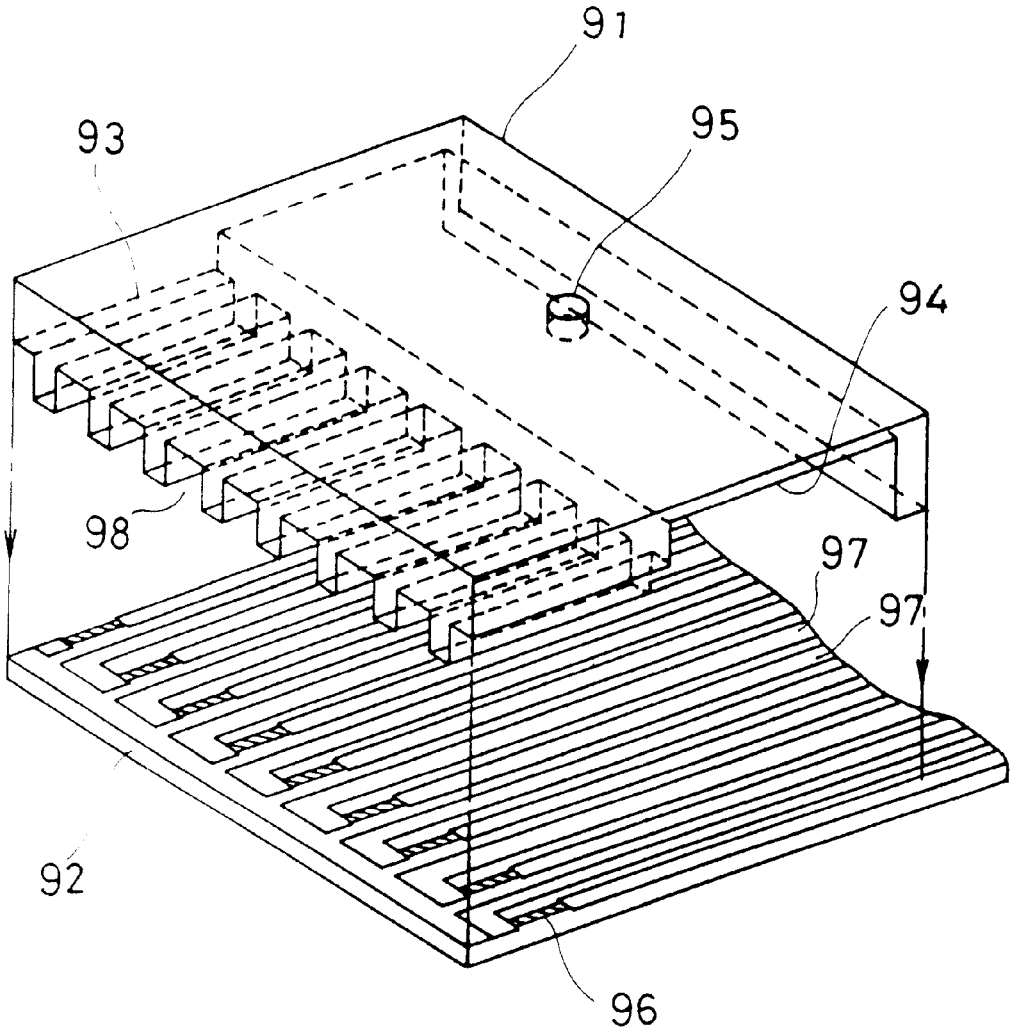
FIG. 3 is a perspective illustration for explaining a general configuration of an ink-jet recording head.

FIG. 3 is a perspective illustration of an ink-jet recording head to be equipped on an ink-jet recording apparatus as one of embodiments of the present invention.

As shown in the figure, the ink-jet recording head is comprised of a top plate 91 and a base plate 92 which are integrated together to form a plurality of orifices 98 for ejecting ink. On the top plate 91, there are formed a plurality of grooves 93 to be provided as nozzles as passages of ink, a groove 94 as a common liquid chamber passing through the grooves 93, and an opening 95 for supplying ink from a source to the common liquid chamber. On the base plate 92, there are formed electrothermal conversion elements 96 which respectively correspond to individual nozzles and electrodes 97 which respectively supply electric power to individual electrothermal conversion elements 96.

The ink-jet recording head thus formed makes up an ink-jet cartridge by integrally connecting with an ink tank responsible for supplying ink thereto through the above opening.

Figure 4:
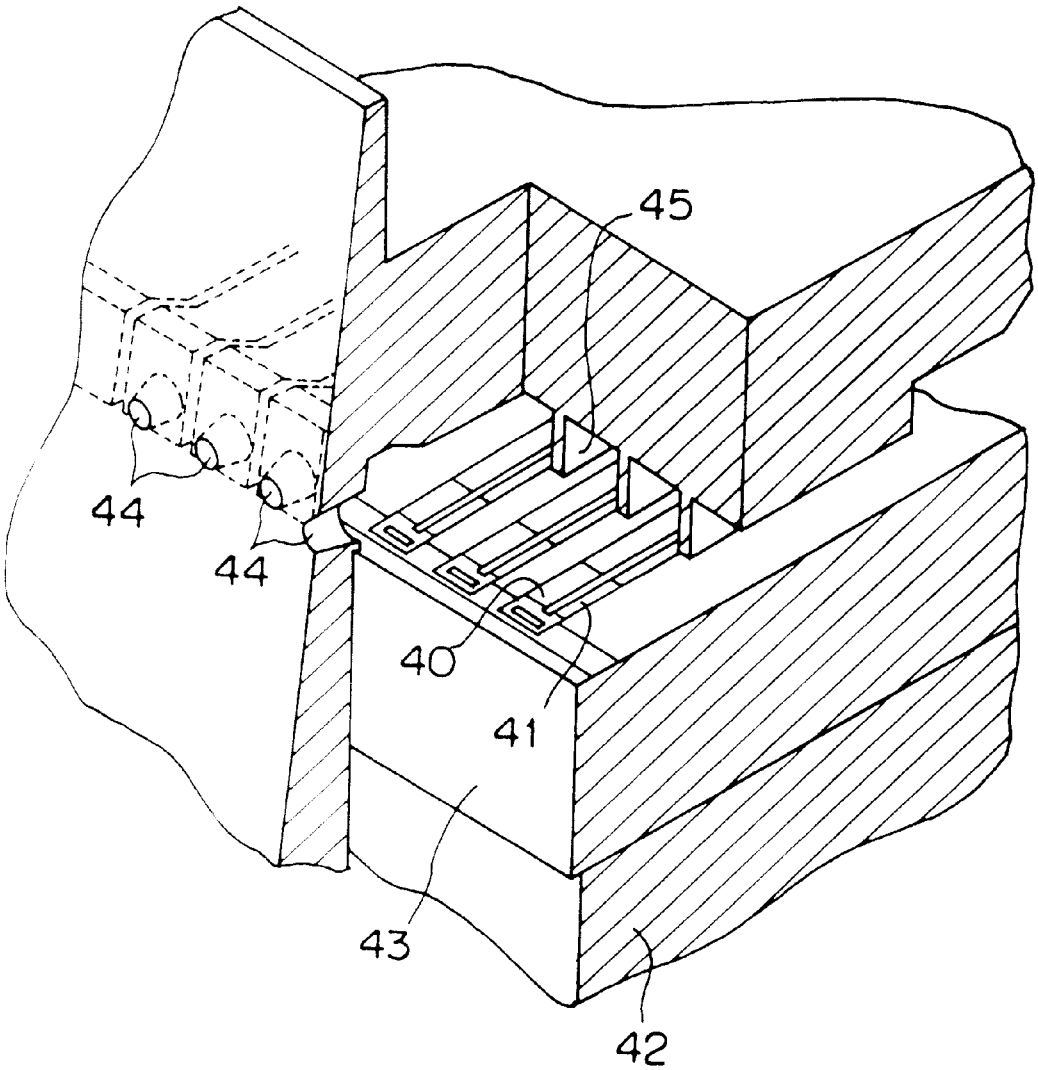
FIG. 4 is a perspective illustration of an edge-shooter type recording head as an example of a recording head to be applied in an ink-jet recording apparatus in accordance with the present invention.
Figure 5:
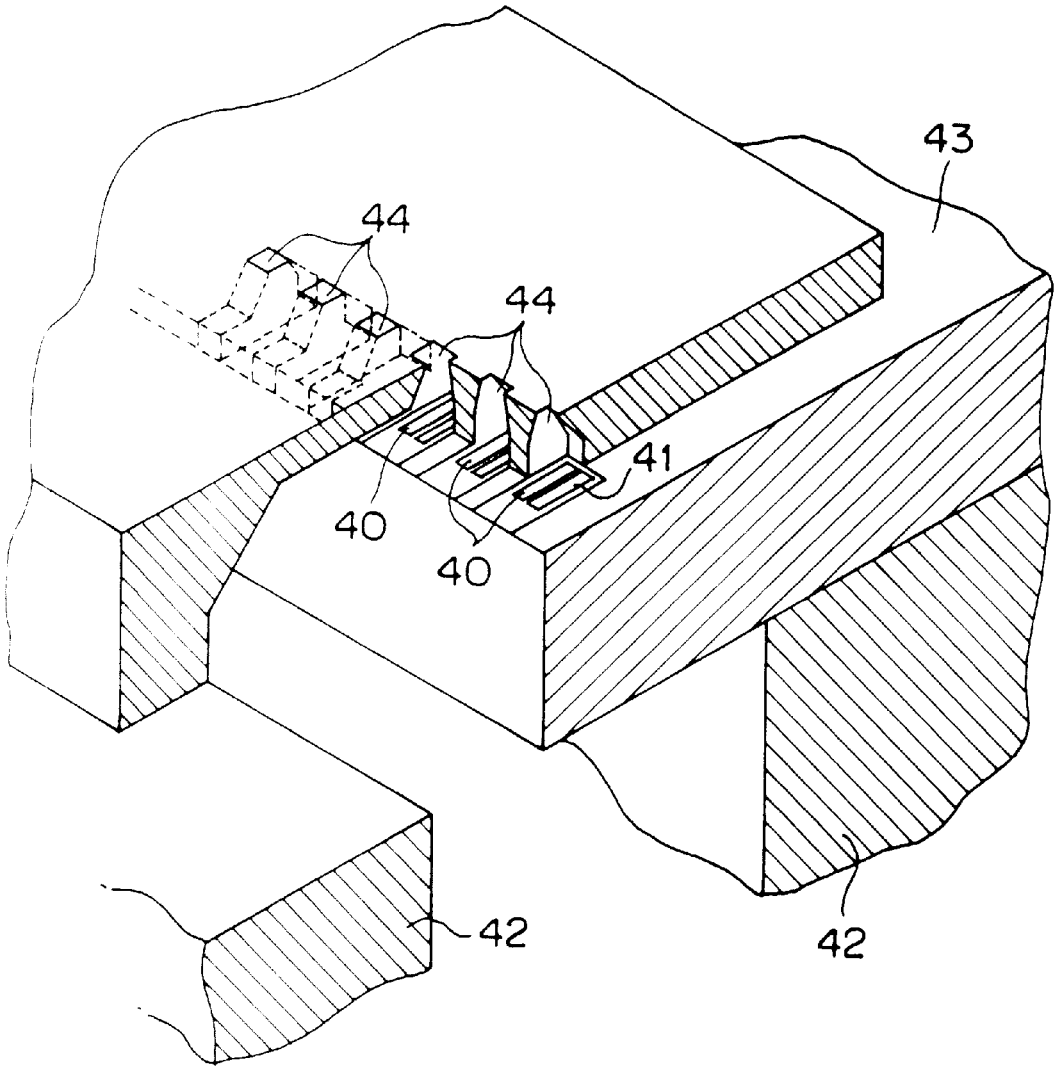
FIG. 5 is a perspective illustration of a side-shooter type recording head as an example of a recording head to be applied in an ink-jet recording apparatus in accordance with the present invention.

Referring now to FIGS. 4 and 5, a recording head which is adaptable to the present invention will be described in a concrete manner, in which FIG. 4 shows a perspective view of an ink-jet recording head of the edge-shooter type while FIG. 5 shows a perspective view of an ink-jet recording head of the side-shooter type. Both recording heads are able to eject an ink droplet from each orifice 44 by generating a bubble by heating ink in an ejection nozzle 45 by a pair of heaters 40, 41 arranged on a substrate 43 bound on a base plate 42.

Figure 6:
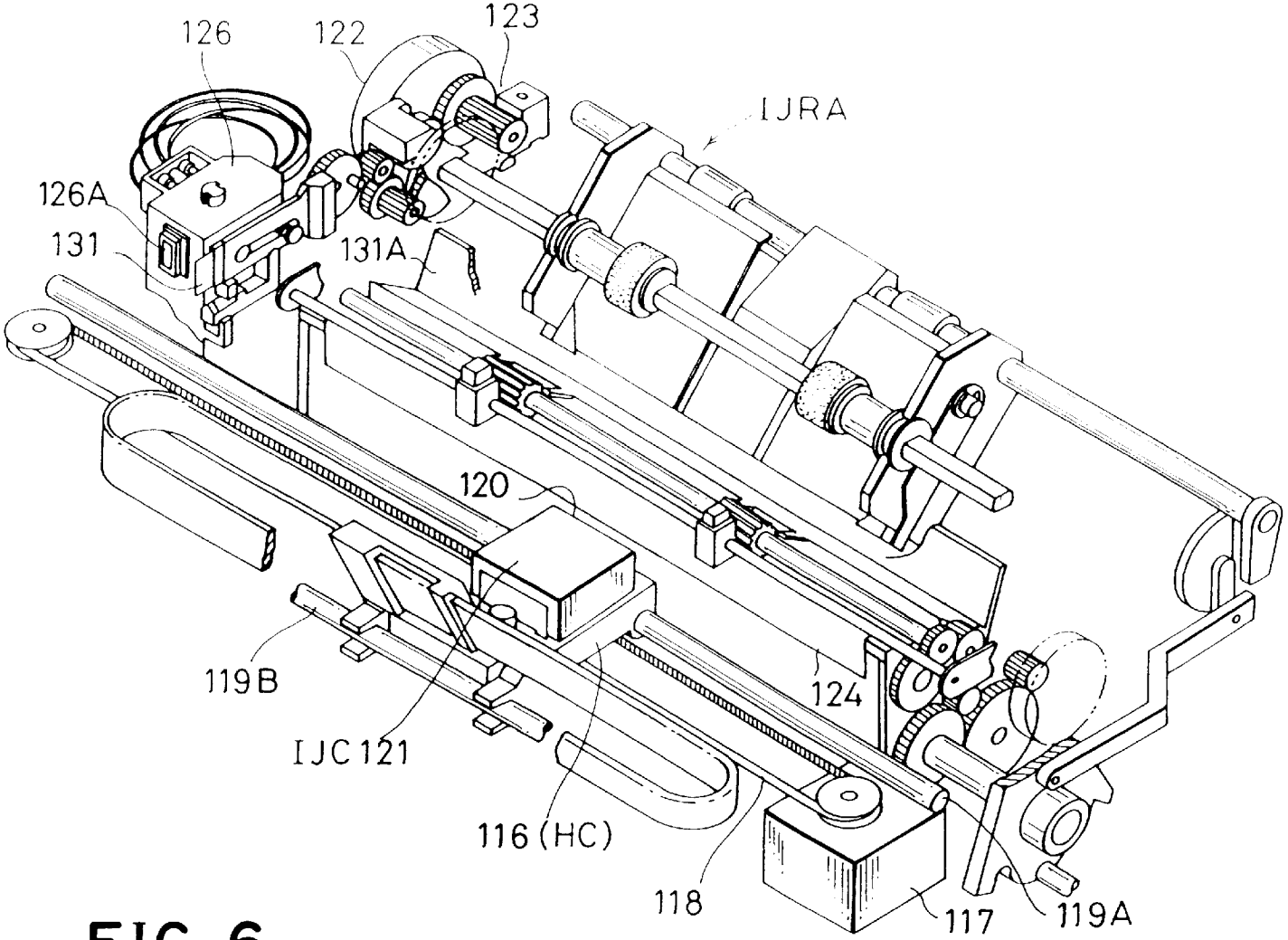
FIG. 6 is a perspective illustration for explaining a general configuration of an ink-jet recording apparatus.

FIG. 6 is an external perspective view of an ink-jet recording apparatus on which the recording head shown in one of FIGS. 3, 4, and 5 can be mounted.

In the figure, reference numeral 120 designates an ink-jet recording head (recording head) for an ink-jet cartridge IJC which includes a group of ink ejecting nozzles facing to the recording surface of a recording paper conveyed onto a platen 124. Reference numeral 116 designates a carriage HC for holding the recording head 120 thereon. The carriage HC is fastened to part of a driving belt 118 which transmits thereto the driving force generated by a driving motor 117. The carriage HC can reciprocally be displaced across the whole width of the recording paper with the aid of two guide shafts 119A and 119B extending in parallel with each other. As data are received by the recording head 120, images are recorded on the recording paper corresponding to the received data during the reciprocal displacement of the recording head 120. The recording paper is conveyed by a predetermined distance on completion of each main scanning, and subsequently, auxiliary scanning is performed with the recording head 120.

Reference numeral 126 designates a head recovering unit which is arranged at the position facing to one end of the path of displacement of the recording head 120, e.g., the position located opposite to a home position of the recording head 120. As the driving force generated by a motor 122 is transmitted via a power transmitting mechanism 123, the head recovering unit 126 is activated, causing the recording head 120 to be capped with a cap portion 126A. Subsequently, ink is sucked (to attain suction recovery) by driving adequate sucking means (e.g., suction pump) disposed in the head recovering unit 126 in operative association with the capping portion 126A of the head recovering unit 126, whereby ink located in the ink ejecting ports of the recording head 120 with increased viscosity is forcibly discharged from the ink ejecting ports, resulting in the recording head 120 being subjected to ink discharge recovering treatment. In addition, the recording head 120 is protected from an occurrence of malfunctions by allowing the recording head 120 to be capped with the capping portion 126A after completion of each recording operation. Such ink discharge recovering treatment as mentioned above is executed when a power source is turned on or when the recording head 120 is replaced with a new one or when no recording operation is performed for a period of time longer than a predetermined one.

Reference numeral 131 designates a blade molded of a silicone rubber. The blade 131 is disposed on the right-hand side surface of the head recovering unit 126 to serve as a wiping member while it is held by a blade holding member 131A in the cantilever-like fashion. Similar to the head recovering unit 126, the blade 131 is actuated by the motor 122 and the power transmitting mechanism 123 until it is engaged with an ink ejecting plane of the recording head 120. The blade 131 is projected in the path of displacement of the recording head 120 at a certain adequate timing during each recording operation performed by the recording head 120 or after the ink discharge recovering treatment conducted by the head recovering unit 126, whereby dew, moisture or dust particle on the ink ejecting plane of the recording head 120 is wiped off by the blade 131 as the recording head 120 is displaced in the leftward/rightward direction.

In this embodiment, by the way, a plurality of nozzles forming the recording head are grouped into several types according to the differences in diameters of their openings and light and dark of ink to be used.

Figure 7:
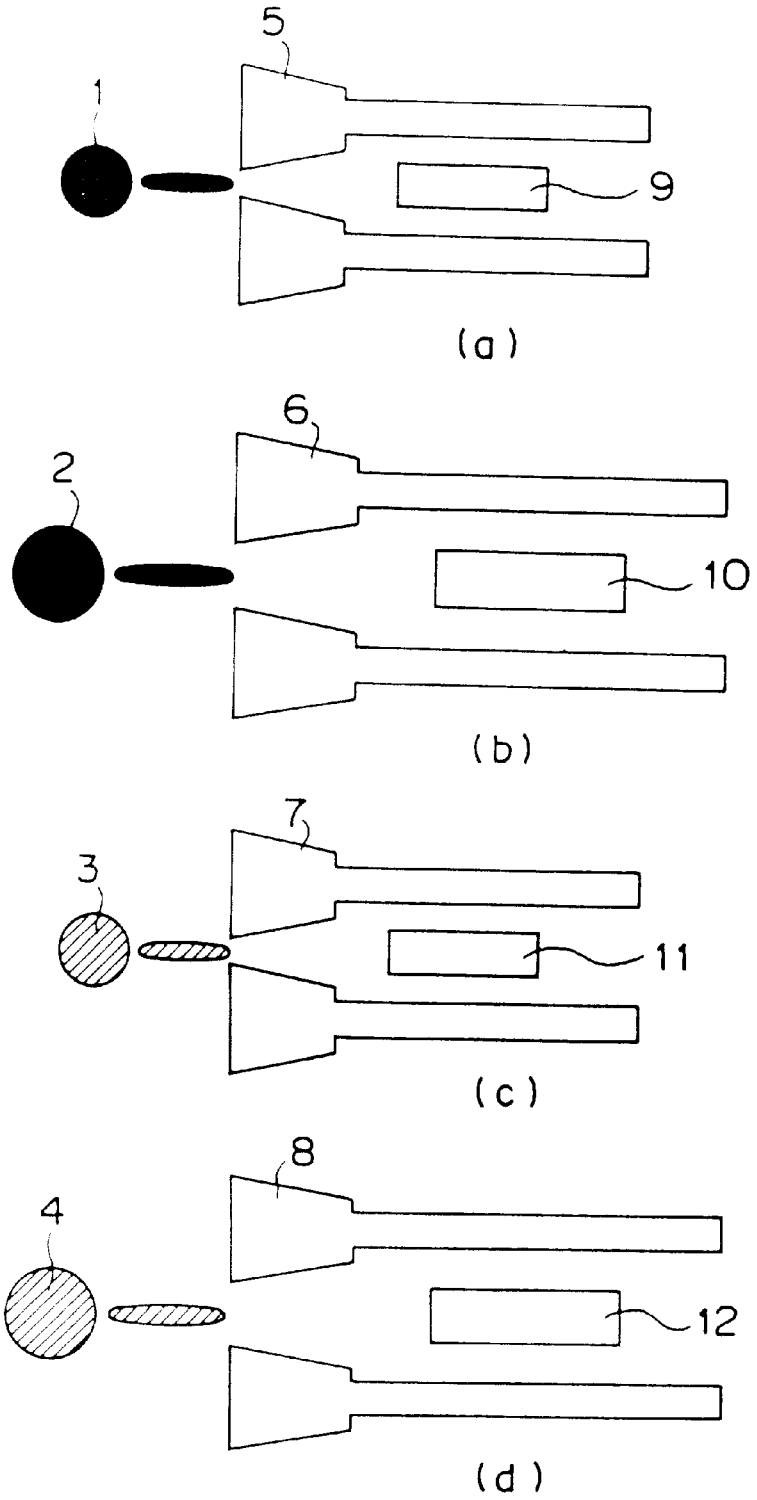
FIG. 7 is a schematic illustration for explaining a configuration of a recording head to be applied in an ink-jet recording apparatus of the present invention, in which (a) to (d) represent different nozzle configurations, respectively.
Figure 8A:
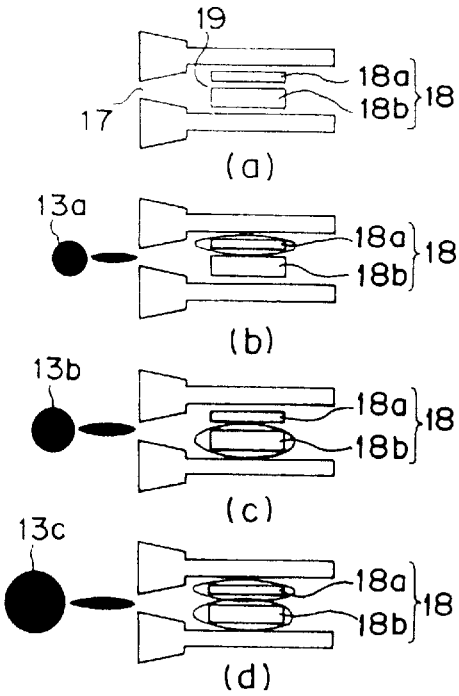
FIGS. 8A to 8D are schematic illustrations for explaining nozzle configurations to be applied in an ink-jet recording apparatus of the present invention and for explaining the patterns of ink-ejection under the conditions of different amounts of ink, respectively, in which (a) to (d) represent the different drive conditions of heaters.
Figure 8B:
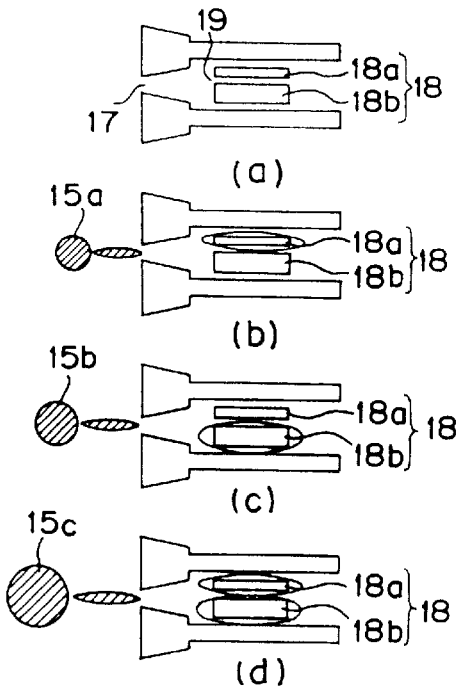
Figure 8C:
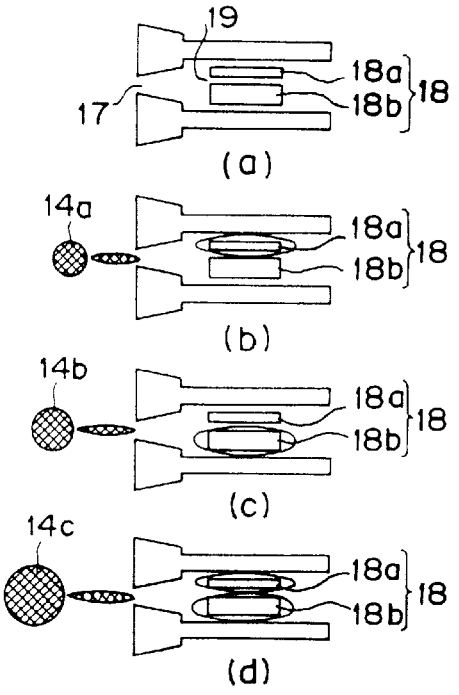
Figure 8D:
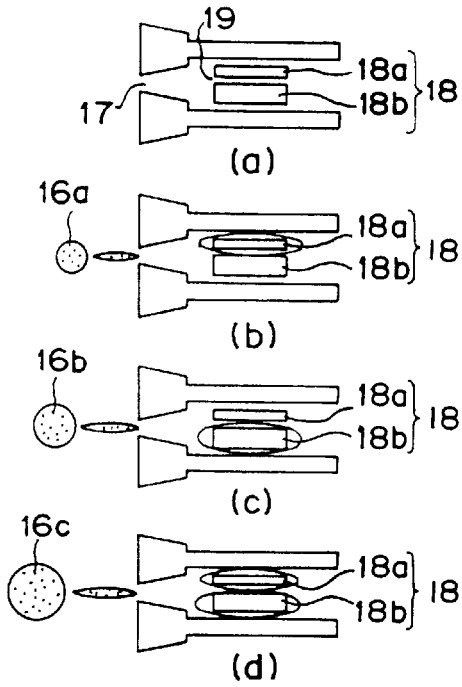

FIG. 7 is a schematic illustration of a configuration of nozzles in the recording head, in which (a) to (d) are in the condition as listed in Table 1 below to record an image with a 5-step gradation. In the figure, furthermore, reference numerals 1 to 4 denote ink droplets, 5 to 8 denote nozzles, and 9 to 12 denote heaters.

TABLE 1

| nozzle type | ejection amount | density of ink |
|---|---|---|
| (a) | small | thick |
| (b) | large | thick |
| (c) | small | light |
| (d) | large | light |

In Table 1, "ejection amount" means the amount of ink to be ejected from one nozzle, "large" means that 80 pl of ink is ejected from the nozzle, and "small" means that 40 pl of ink is ejected from the nozzle.

There is no need to size the nozzles (a) and (c) or (b) and (d) in the same one because the difference in light and dark of the ink may influence on the viscosity or the like of the ink and it results in the differences in ejection properties. Therefore it is preferable to adjust a diameter of the orifice, a size and shape of the heater, and a position of the heater in the nozzle, according to the properties of ink to ensure a stable ink-ejection.

Furthermore, it is possible to drive each nozzle under the same conditions by designing the heaters to unify driving voltage when the heater size is adjusted.

Embodiment 2

In the first embodiment, the number of heaters is one per each nozzle, but in this embodiment each nozzle is in the type of having a plurality of heaters.

FIGS. 8A to 8D show configurations of nozzles of an ink-jet recording head to be applied in an ink-jet recording apparatus of the present invention, in which these figures illustrate the conditions of ejecting ink droplets from nozzles using ink of different concentration, respectively. In each figure, furthermore, (a) to (d) represent the driving conditions of heaters, respectively. In these figures, reference numerals 13*a* to 13*c*, 14*a* to 14*c*, 15*a* to 15*c*, and 16*a* to 16*c* denote ink droplets. Reference numeral 17 denotes an orifice for ejecting ink out, 18*a* denotes a large-sized heater, 18*b* denotes a small-sized heater, and 19 denotes a nozzle. In each figure, heaters under the driven conditions are surrounded by ellipses, respectively.

In the case that only the small-sized heater is driven, the amount of ink ejected from the nozzle is 30 ng. In the case that only the large-sized heater is driven, on the other hand, the amount of ink ejected from the nozzle is 60 ng. Furthermore, in the case that both large- and small-sized heaters are driven at the same time, the amount of ink ejected from the nozzle is 90 ng.

Accordingly, a 13-step gradation can be attained by a combination of 4 types of ink having different concentration in addition to selective driving of small- and large-sized heaters. That is, each nozzle of the ink-jet recording head has the properties shown in Table 2, so that the 13-step gradation that includes a step of not ejecting any ink can be obtained for representing a density of the image to be recorded.

In the same way as that of the present embodiment, a detailed gradation can be expressed by performing the recording process that uses: first image densities obtained by ejecting inks of different concentration in the same volume; and second image densities obtained by ejecting inks of further different concentration so as to be found by linear interpolation from the first.

In this embodiment, by the way, large- and small-sized heaters are arranged in the same flow path for modulating the amount of ejected ink, but it is not limited. It is also possible to use different types of nozzles in which one ejects the large amount of ink while other ejects the small amount of ink.

TABLE 2

| levels of gradation | ink density | types of driven heater |
|---|---|---|
| 1 | A | — |
| 1 | B | — |
| 1 | C | — |
| 1 | D | — |
| 2 | D | small |
| 3 | D | large |
| 4 | D | small & large |
| 5 | C | small |
| 6 | C | large |
| 7 | C | small & large |
| 8 | B | small |
| 9 | B | large |
| 10 | B | small & large |
| 11 | A | small |
| 12 | A | large |
| 13 | A | small & large |

In the above table, the ink concentration A, B, C, and D are in the relation of A>B>C>D.

Embodiment 3

Figure 9:
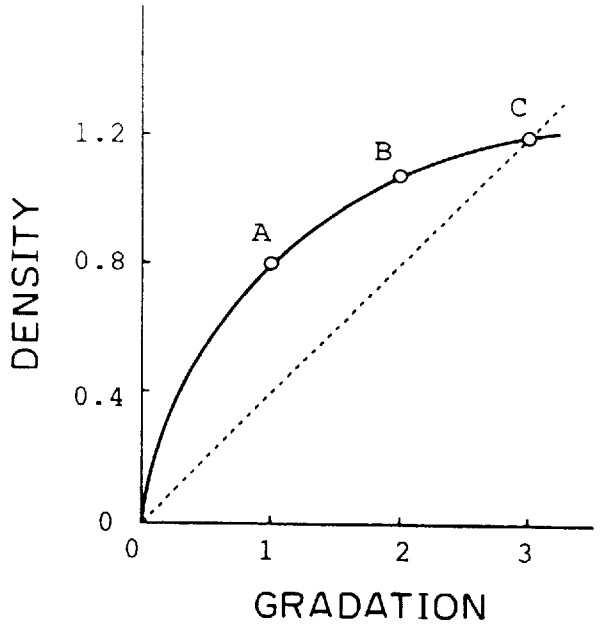
FIG. 9 is a graphical representation for explaining the relationship between the ink-density and the gradation (3 levels)
Figure 10:
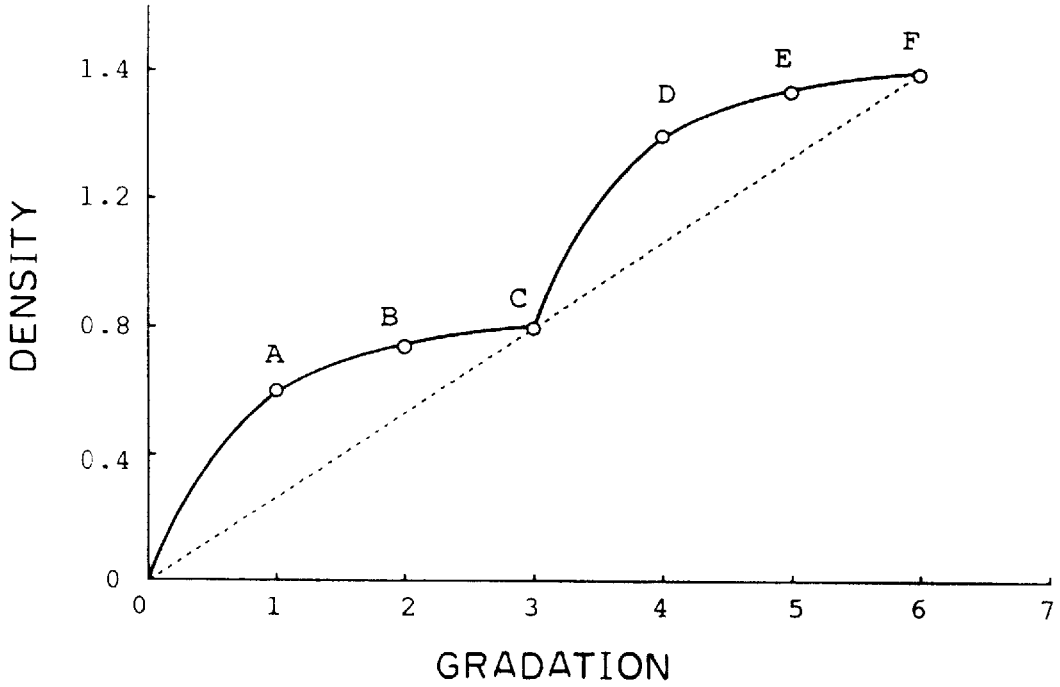
FIG. 10 is a graphical representation for explaining the relationship between the ink-density and the gradation (6 levels)

In the second embodiment, a linear ejection property is applied, for example the variable amounts of ink to be ejected are defined as 30 ng for the small-sized heater, 60 ng for the large-sized heater, and 90 ng for a combination of these heaters. However an image density on a recording medium represents the actual gradation, as shown in FIG. 9, so that the linear ejection property complicates the regulation of attaining an image reproducibility because of a nonlinear relationship of the ink density with the gradation regulation. In FIG. 10, there is illustrated a 6-step gradation which can be attained by the recording head in the type of two different ink densities. In this case, however, it is also significantly shifted from the linear property. On the other hand, the present embodiment uses an image-density modulation by the differences in ejecting amounts, especially a nonlinear property of ejecting amounts, wherein an image density is adjusted by the difference in two ink concentration, and the variable amounts of ink to be ejected are defined as 10 ng for the small-sized heater, 80 ng for the large-sized heater, and 90 ng for a combination of these heaters. According to the present embodiment, therefore, the recording densities of two different types of nozzles having different ink concentration are adjusted so as to be represented as the lines in FIGS. 11 and 12, respectively. A combination of these lines is illustrated in FIG. 13. By replacing the order of levels in accordance with the density properties, the gradation/density properties are obtained significantly close to a straight line and so a density-reproducibility becomes excellent. That is, it becomes possible to provide a detailed gradation representation with a high-linearity in a wide range of density region. This kind of the gradation representation has been never attained by the conventional ways of adjusting the gradation by only changing ink concentration or by only changing the amount of ink to be ejected. In the present embodiment, by the way, it is also possible to represent the above gradation by increasing the number of levels thereof as a result of a linear interpolation between the differences in the image densities depended on the different ink concentration and the image densities depended on the different amounts of ink ejected, as described in the second embodiment.

Embodiment 4

Figure 11:
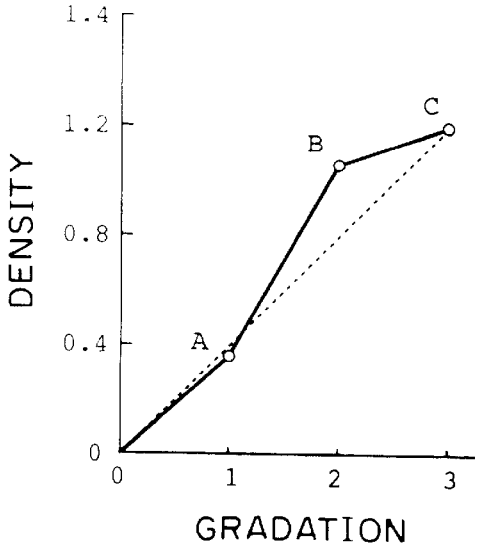
FIG. 11 is a graphical representation for explaining the relationship between the ink-density and the gradation (3 levels)
Figure 12:
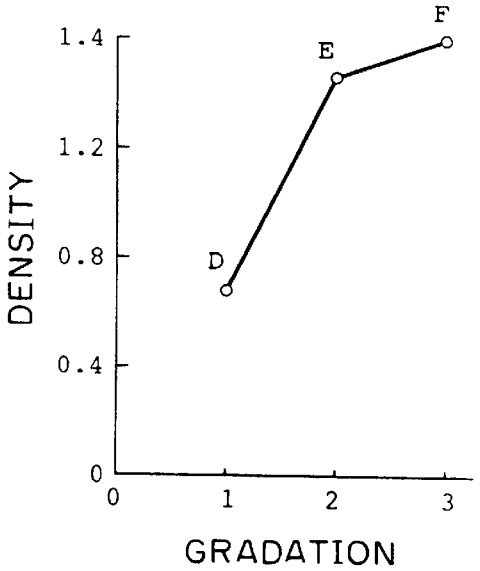
FIG. 12 is a graphical representation for explaining the relationship between the ink-density and the gradation (3 levels)
Figure 13:
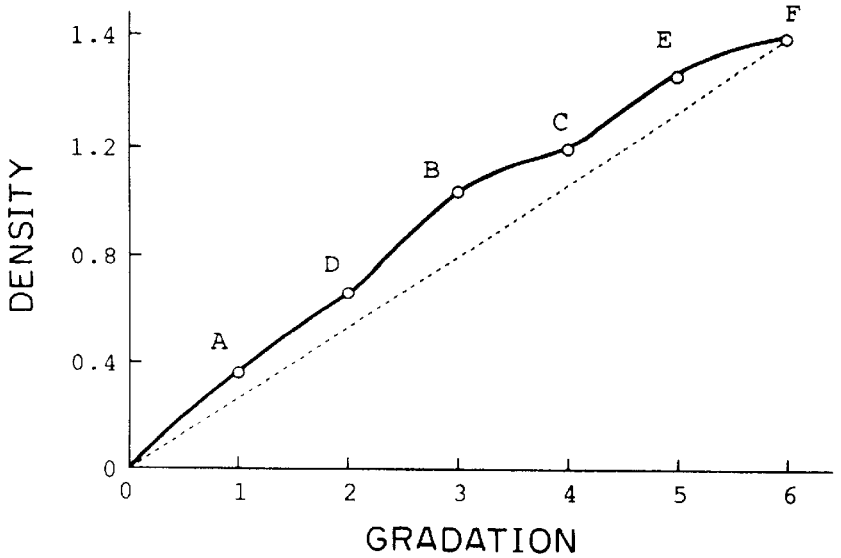
FIG. 13 is a graphical representation for explaining the relationship between the ink-density and the gradation (6 levels)

In this embodiment, a gradation representation is obtained by combining the process of representing a gradation by means of multiple-droplets and at least one process described in the first or second embodiment for adjusting the amount of ejecting ink (see FIGS. 11 to 13).

Figure 14B:
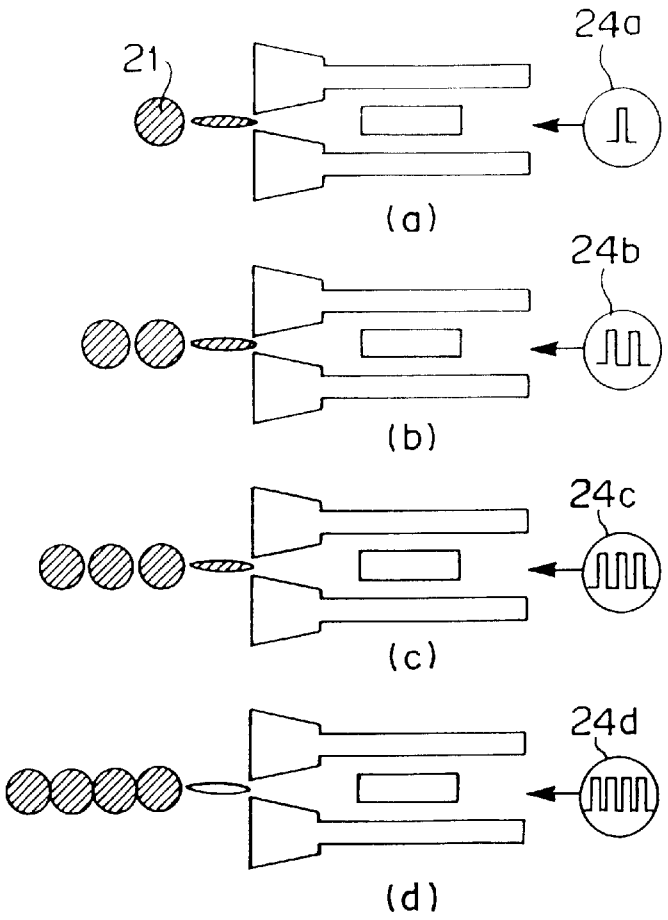
FIGS. 14A and 14B are schematic illustrations for explaining the patterns of ink-ejection under a combination of a gradation representation of multiple droplets system with a regulation of ejection amounts of first or second embodiment, in which the numbers of drive pulses are different from each other.
Figure 14A:
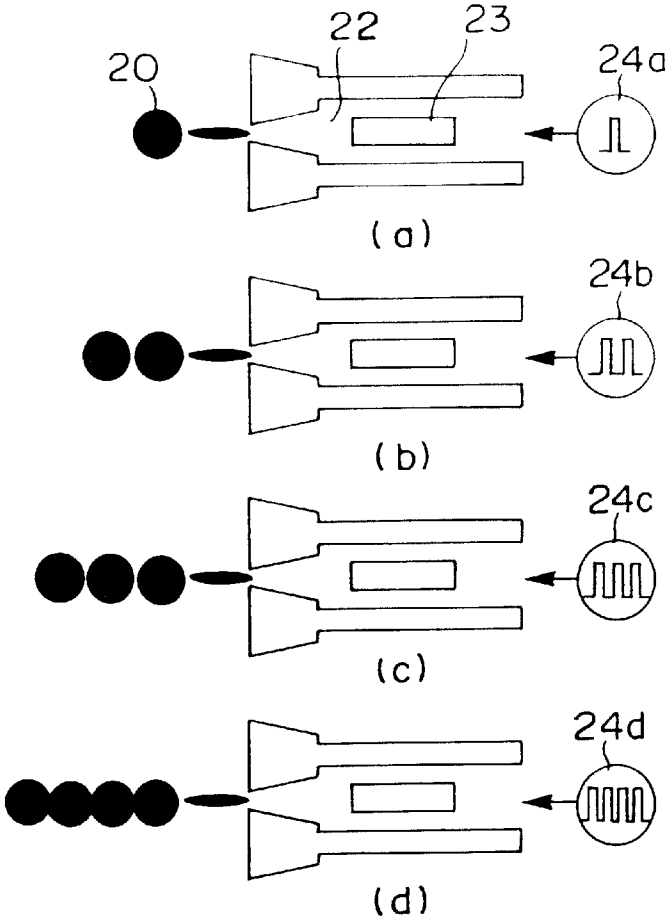

In FIGS. 14A and 14S, reference numerals 20 and 21 denote ink droplets, 22 denotes a nozzle, 23 denotes a heater, and 24*a* to 24*d* denote drive pulses.

In this embodiment, there are two different concentrations of ink (i.e., dilute ink and thick ink) and the drive pulses are impressed by 5 different ways, resulting that a 9-steps gradation can be represented In this case, the conventional image of a rough-touch with a granularity was improved by using the condition of ejecting dilute ink as a small dot on a significantly light area of the image. In addition, a smooth outline was obtained by the condition of ejecting thick ink as a small dot with respect to a sloped line and a curved line in the image of black character or the like.

TABLE 3

| levels of gradation | number of drive pulse | ink density |
|---|---|---|
| 1 | 0 | thick |
| 1 | 0 | light |
| 2 | 1 | light |
| 3 | 2 | light |
| 4 | 3 | light |
| 5 | 4 | light |
| 6 | 1 | thick |
| 7 | 2 | thick |
| 8 | 3 | thick |
| 9 | 4 | thick |

As described above, the ink-jet recording apparatus of the present invention comprises a plurality of nozzles which are constructed as at least two types, i.e., a first nozzle type and a second nozzle type, the first one is different from the second one in at least one way selected from the group of the amount of ink to be ejected, the number of ink droplets, and the number of drive pulses for ejecting ink, by each pixel, so that the number of levels of a gradation representation can be increased.

The number of levels of the gradation representation can be also increased by changing one of the properties of ink: concentration, tone, viscosity, and a combination thereof.

It becomes possible to represent further strict gradation by using a means of changing the ejection amounts of ink by arranging a plurality of heaters in each nozzle in addition to select the type of ink. Simultaneously, it is also possible to increase the reproducibility of a gray-scale image by improving a linearity of adjusting the gradation.

By the way of applying the same levels of driving voltage on a plurality of the nozzles, it becomes possible to drive them under the same conditions and also it allows to mount and drive another recording means easily.

Furthermore, an image recording with a further improved image quality can be attained as the number of levels of the gradation representation increases when electrothermal transducers are used as energy-generating elements of the nozzles.

The following are supplemental remarks of the configuration of an ink-jet recording apparatus to be applied in the present invention.

Figure 15:
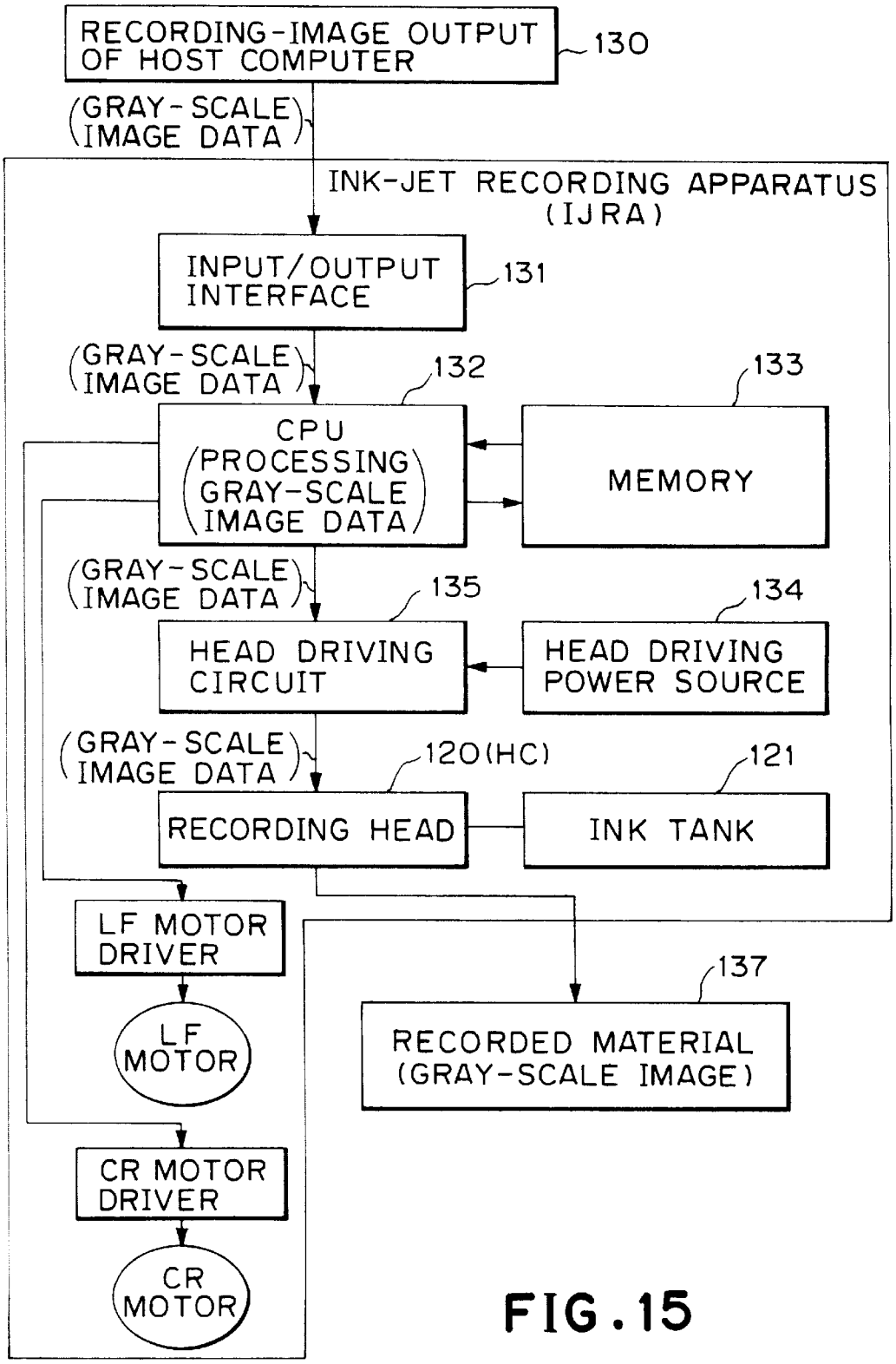
FIG. 15 is a block diagram for explaining a configuration of an ink-jet recording apparatus that performs a gray-scale image formation.

FIG. 15 is a schematic block diagram for more detailed description of the ink recording apparatus to be applied in the present invention. The ink-jet recording apparatus IJRA receives signals as recording data from a host computer 130 at an input/output interface portion 131. The recording signals include image data with gradation data. The recording signals being received in the input/output interface are introduced into a central processing unit (CPU) 132 and stored in a memory 133 for the time being. Alternatively the recording signals are provided as recording data and processed into data to be recorded on a recording medium and at the same time the gradation data is also processed, resulting that gray-scale image data are obtained. This processed gray-scale image data is transmitted into the recording head 120 (HC) connecting with the CPU 132 through a head-driving circuit 135. The recording head 120 is selectively driven by a driving power supplied from a head-driving electric source 134 through the head driving circuit 135, and then the recording head 120 ejects ink supplied from an ink tank (or ink reservoir) 121 onto a recording medium 137 to form an image.

Figure 16:
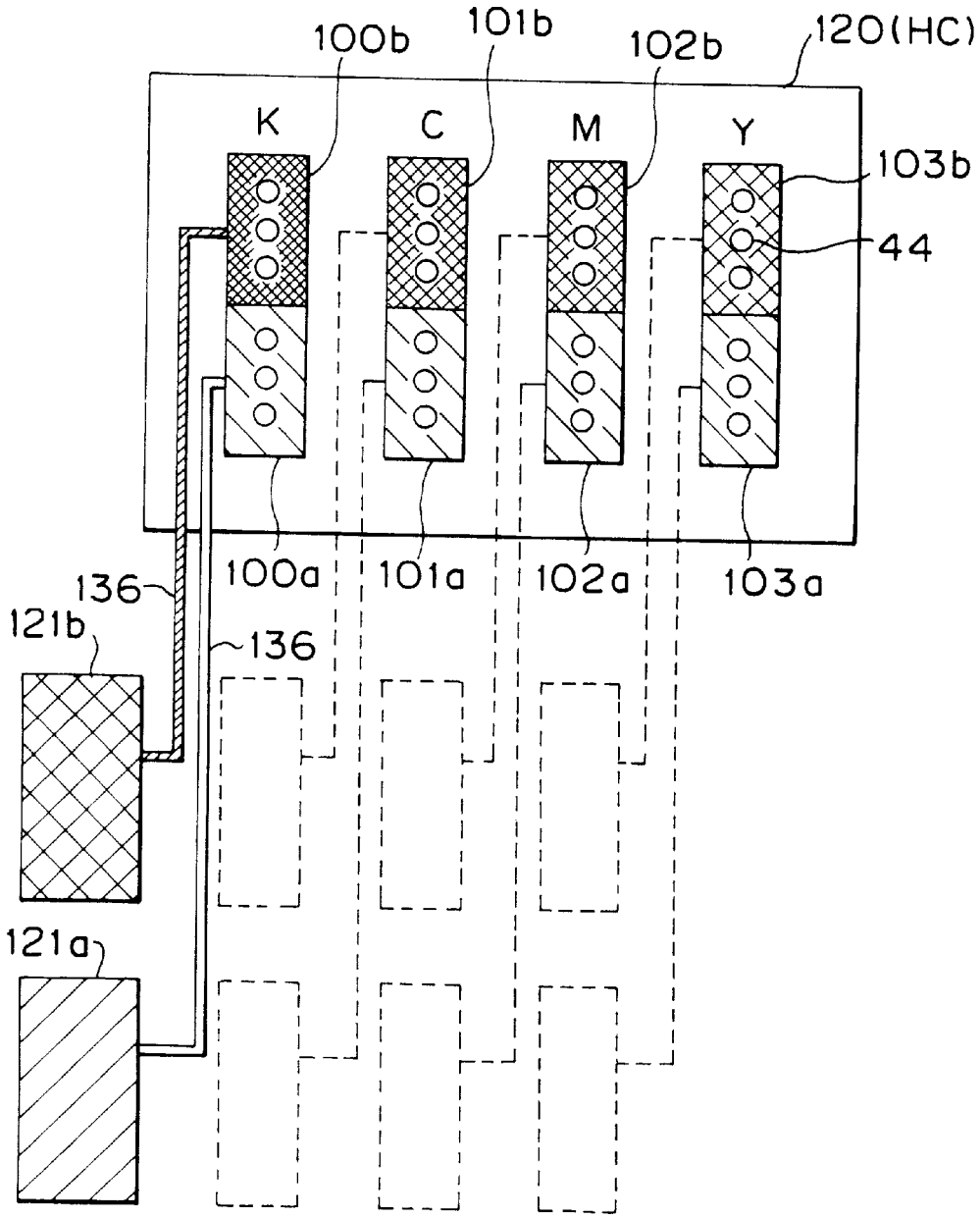
FIG. 16 is a schematic illustration for explaining a general configuration of a recording head for recording with gradation and ink tanks.

FIG. 16 is a schematic block diagram for further detailed explanation of the ink-jet recording head 120(HC) shown in FIG. 15.

In this case, the recording head 120(HC) is of the type having four individual heads so as to correspond to colors of black (K), cyan (C), magenta (M), and yellow (Y), but the number of the heads is not limited to 4. Depending on a usage pattern of ink or the like, it is possible to mount one or more than one recording head of specific color ink. Each of those recording heads of K, C, M, and Y comprises nozzles 44 which are able to elect ink individually by driving the recording head as described above. In each head, nozzle lines are separated into two portions, i.e., thick ink portions 100*b*–103*b* and light ink portions 100*a*–103*a*, respectively, so as to be configured to eject both thick and light ink from each head. The thick ink portions 100*b*–103*b* are connected with their own thick ink tanks 121*b* (to simplify the diagram, others are shown by the dotted lines) for receiving a supply of thick ink. On the other hand, the light ink portions 100*a*–103*a* are connected with their own light ink tanks 121*a* (to simplify the diagram, others are shown by the dotted lines) for receiving a supply of light ink. The number of nozzles 44 may be determined as necessary, so that one or more nozzles 44 may be arranged for each of colors and also for each of ink densities. In addition, more variations in ink may be acceptable in case of necessity.

Figure 17:
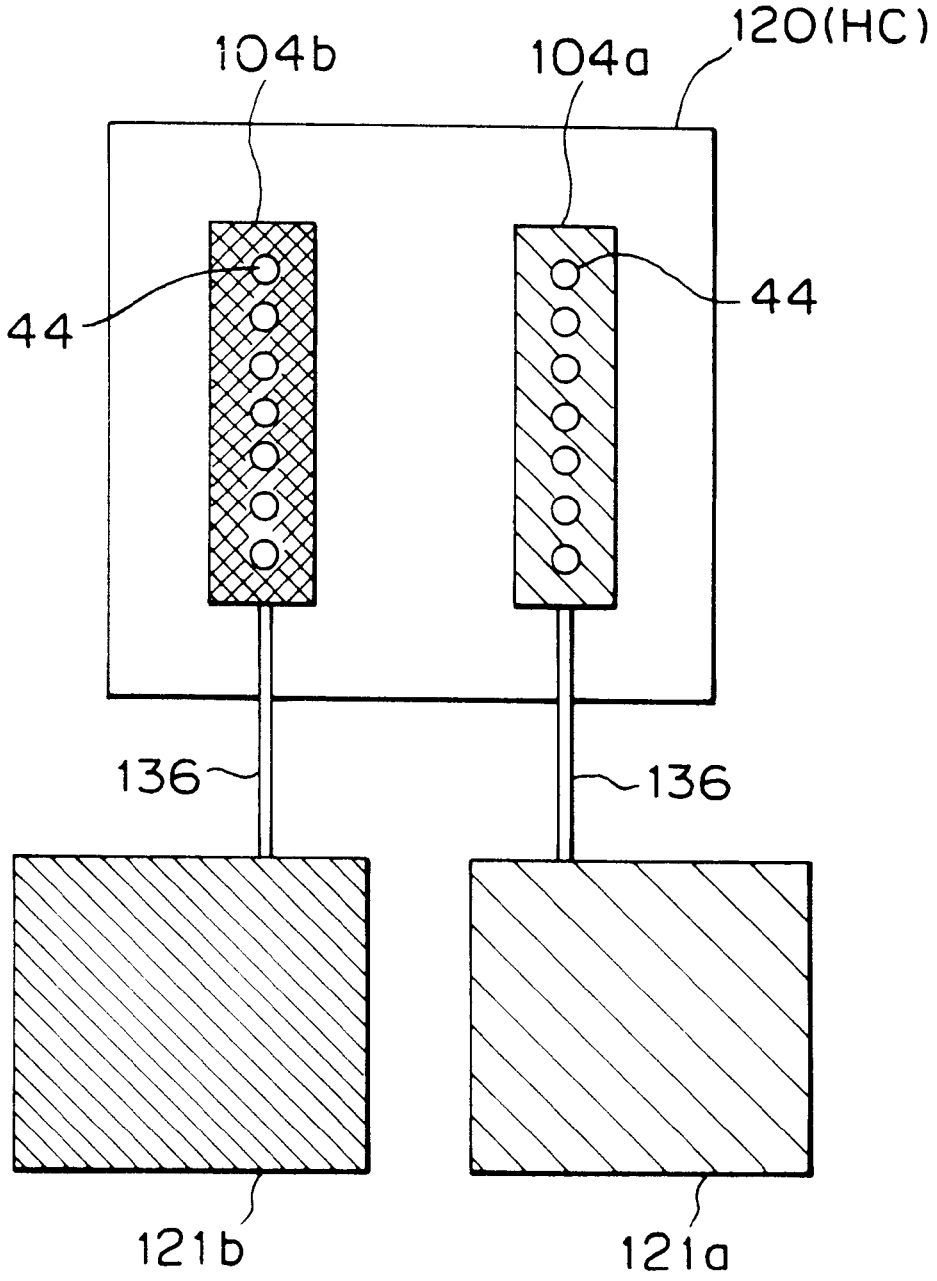
FIG. 17 is a schematic illustration for explaining another configuration of a recording head for recording with gradation and ink tanks.

FIG. 17 is another embodiment of a combination of an ink-jet recording head and ink tanks.

In this embodiment, a thick-ink head 104*b* and a light-ink head 104*a* are separately arranged in the recording head 120 (HC) and they receive their own ink from a thick-ink tank 121*b* and a light-ink tank 121*a* through ink-guide tubes 136, respectively.

In the embodiment shown in FIGS. 16 and 17, a multiple-drop system with one heater per one nozzle or another system that uses the different sized orifices may be also adopted. In the case of adopting the configuration of the second embodiment in which the recording head has a plurality of heaters in one nozzle to the present embodiment, an exceedingly represented gradation (i.e., a high gradation and a linearity of gradation) of images can be easily attained. In addition, it is notable that a high-speed recording can be performed under the condition of a high gradation because of forming one pixel by one dot corresponding to one ejection.

Other Embodiments

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

According to the present invention, a gradation regulation can be achieved by adjusting both of a quantity and a concentration of ink to be ejected onto a recording medium for each pixel.

The present invention has been described in detail with respect to preferred embodiments, and it will be that changes and modifications may be made without departing from the invention in its broader aspects, and it is the intention, therefore, in the appended claims to cover all such changes and modifications as fall within the true spirit of the invention.

What is claimed is:

1. A method for making a record with multiple levels of gradation on a recording medium, comprising the steps of:

providing a means for ejecting inks of different densities in a plurality of ejection amounts, respectively;

linearizing a relationship between gradation and image density so that levels of the gradation of each of the inks of different densities are interpolated by the different densities in a plurality of ejection amounts; and making the record on the recording medium in response to multiple-level recording data in accordance with the relationship between gradation and image density.

2. A method as claimed in claim 1, wherein in said record making step, the means for ejecting inks of different densities in a plurality of ejection amounts comprises a plurality of energy-generating means arranged in one nozzle.

3. A method as claimed in claim 1, wherein a line of nozzles that constitutes one recording head ejects the inks of different densities in said record making step.

4. A method as claimed in claim 1, wherein said record making step utilizes a plurality of recording heads including at least one recording head having at least the inks of different densities.

5. An ink-jet recording apparatus for making a record with multiple levels of gradation on a recording medium, comprising:

means for ejecting inks of different densities in a plurality of ejection amounts, respectively;

means for linearizing a relationship between gradation and image density so that levels of the gradation of each of the inks of different densities are interpolated by the different densities in a plurality of ejection amounts; and means for making the record on the recording medium by ejecting inks from said ejection means in response to multiple-level recording data in accordance with the relationship between gradation and image density.

* * * * *

UNITED STATES PATENT AND TRADEMARK OFFICE

CERTIFICATE OF CORRECTION

PATENT NO. : 6,142,599

DATED : November 7, 2000

INVENTOR(S) : ISHINAGA ET AL.

It is certified that error appears in the above-identified patent and that said Letters Patent is hereby corrected as shown below:

COLUMN 1:
Line 23, "the" should read --a--.
Line 42, "directions" should read --direction)--.

COLUMN 2:
Line 18, "followings." should read --following.--.
Line 22, "to" should be deleted.
Line 40, "waits" should read --waits for--.

COLUMN 3:
Line 24, "an" should read --a--.
Line 64, "a" should read --an--.

COLUMN 5:
Line 47, "comprising" should read --comprising:--.

COLUMN 7:
Line 12, "droplet," should read --droplets,--.

COLUMN 8:
Line 3, "to" should be deleted.
Line 20, "to" should be deleted.

COLUMN 9:
Line 19, "on" should be deleted.
Line 37, "concentration," should read --concentrations,--.
Line 55, "concentration" should read --concentrations--.

UNITED STATES PATENT AND TRADEMARK OFFICE

CERTIFICATE OF CORRECTION

PATENT NO. : 6,142,599

DATED : November 7, 2000

INVENTOR(S) : ISHINAGA ET AL.

It is certified that error appears in the above-identified patent and that said Letters Patent is hereby corrected as shown below:

COLUMN 10:
Line 47, "concentration," should read --concentrations,--.
Line 52, "concentration" should read --concentrations--.
Line 61, "been never" should read --never been--.

COLUMN 11:
Line 1, "depended" should read --dependent--.
Line 2, "depended" should read --dependent--.

COLUMN 12:
Line 32, "elect" should read --eject--.

COLUMN 14:
Line 33, "of" should be deleted.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*